US009811030B2

(12) United States Patent
Masuda

(10) Patent No.: US 9,811,030 B2
(45) **Date of Patent: *Nov. 7, 2017**

(54) IMAGE FORMING APPARATUS

(71) Applicant: Sharp Kabushiki Kaisha, Osaka (JP)

(72) Inventor: Junya Masuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/297,641

(22) Filed: Oct. 19, 2016

(65) Prior Publication Data

US 2017/0038709 A1 Feb. 9, 2017

Related U.S. Application Data

(63) Continuation of application No. 14/325,403, filed on Jul. 8, 2014, now Pat. No. 9,507,298, which is a (Continued)

(30) Foreign Application Priority Data

Oct. 23, 2009 (JP) ..... 2009-244048

(51) Int. Cl.
*G03G 21/20* (2006.01)
*G03G 15/20* (2006.01)
(Continued)

(52) U.S. Cl.
CPC ..... *G03G 15/2028* (2013.01); *B65H 5/26* (2013.01); *G03G 15/2017* (2013.01);
(Continued)

(58) Field of Classification Search
None
See application file for complete search history.

(56) References Cited

U.S. PATENT DOCUMENTS 4,959,693 A 9/1990 Mitsuya et al.
5,142,340 A 8/1992 Farrell
(Continued)

FOREIGN PATENT DOCUMENTS

JP 07-257802 A 10/1995
JP 11296053 A * 10/1999
(Continued)

OTHER PUBLICATIONS

Co-pending U.S. Appl. No. 14/325,403, filed Jul. 8, 2014 (application provided).
(Continued)

*Primary Examiner* — David M Gray
*Assistant Examiner* — Geoffrey T Evans
(74) *Attorney, Agent, or Firm* — Renner, Otto, Boisselle & Sklar, LLP

(57) ABSTRACT

To provide an image forming apparatus in which the paper is cooled early by blowing air to the paper in the conveying path so as to prevent a sticking phenomenon on a paper output tray while paper turning, paper folding, paper breakage and paper jamming due to influence on paper conveyance by blowing air onto the paper in the conveying path, can be prevented. At the start of paper conveyance, a gate 73 is turned upwards to a first position to thereby close a sixth conveying path 44 and establish communication between a first conveying path 42 and a second conveying path 43 so that the paper having passed through a fixing unit 21 starts to be conveyed from first conveying path 42 to second conveying path 43. At the same time, air is exhausted from an exhausting mechanism 53 arranged upstream of a cooling mechanism 76. When a first paper sensor 74 detects the leading end of the paper, a cooling fan 77 starts to rotate at a predetermined rotational rate to start blowing air at a predetermined volume of cooling airflow.

5 Claims, 17 Drawing Sheets

Related U.S. Application Data continuation of application No. 13/500,936, filed as application No. PCT/JP2010/068719 on Oct. 22, 2010, now Pat. No. 8,811,849.

(51) Int. Cl.
*B65H 5/26* (2006.01)
*G03G 15/00* (2006.01)
*G03G 15/23* (2006.01)

(52) U.S. Cl.
CPC ..... *G03G 15/2021* (2013.01); *G03G 15/657* (2013.01); *G03G 15/6558* (2013.01); *G03G 21/206* (2013.01); *B65H 2301/33312* (2013.01); *B65H 2301/5144* (2013.01); *B65H 2801/06* (2013.01); *G03G 15/235* (2013.01); *G03G 2221/1645* (2013.01)

(56) References Cited

U.S. PATENT DOCUMENTS

| | | | | |
|---|---|---|---|---|
| 7,003,242 | B2 | 2/2006 | Kida | |
| 7,315,721 | B2 | 1/2008 | Kitayama | |
| 7,865,122 | B2 | 1/2011 | Koyama | |
| 8,005,393 | B2 | 8/2011 | Satomi | |
| 8,045,914 | B2 | 10/2011 | Kato | |
| 8,351,814 | B2 | 1/2013 | Kasuga | |
| 8,521,076 | B2 | 8/2013 | Masuda | |
| 8,811,849 | B2 | 8/2014 | Masuda | |
| 9,507,298 | B2 * | 11/2016 | Masuda | B65H 5/26 |
| 2004/0091281 | A1 | 5/2004 | Kimizuka | |
| 2004/0145112 | A1 | 7/2004 | Matsutomo | |
| 2004/0228647 | A1 | 11/2004 | Kida | |
| 2006/0051124 | A1 * | 3/2006 | Oka | G03G 21/206 399/94 |
| 2006/0133865 | A1 | 6/2006 | Nakamura et al. | |
| 2006/0285900 | A1 * | 12/2006 | Kurita | G03G 15/6573 399/361 |
| 2007/0019981 | A1 | 1/2007 | Kawamata | |
| 2007/0280721 | A1 | 12/2007 | Kanai | |
| 2008/0044213 | A1 | 2/2008 | Kato et al. | |
| 2008/0240769 | A1 | 10/2008 | Kawasaki et al. | |
| 2009/0103959 | A1 | 4/2009 | Koyama et al. | |
| 2009/0252525 | A1 | 10/2009 | Kojima | |
| 2010/0207975 | A1 * | 8/2010 | Kawakami | B41J 29/393 347/9 |
| 2010/0329726 | A1 | 12/2010 | Kasuga | |
| 2011/0221845 | A1 | 9/2011 | Ue | |
| 2012/0121286 | A1 | 5/2012 | Suzuki | |
| 2012/0301174 | A1 | 11/2012 | Masuda | |
| 2014/0161481 | A1 | 6/2014 | Udagawa | |
| 2015/0086252 | A1 | 3/2015 | Masuda | |
| 2015/0338796 | A1 | 11/2015 | Koga | |
| 2016/0085209 | A1 | 3/2016 | Nakamura | |
| 2016/0154359 | A1 | 6/2016 | Watanabe | |

FOREIGN PATENT DOCUMENTS

| | | | | |
|---|---|---|---|---|
| JP | 2000187417 | A | * | 7/2000 |
| JP | 2001-255807 | A | | 9/2001 |
| JP | 2001330998 | A | * | 11/2001 |
| JP | 2002-062702 | | | 2/2002 |
| JP | 2002-116678 | A | | 4/2002 |
| JP | 2003-208043 | A | | 7/2003 |
| JP | 2006-026747 | | | 2/2006 |
| JP | 2006-106668 | A | | 4/2006 |
| JP | 2006-267479 | A | | 10/2006 |
| JP | 2007-248765 | A | | 9/2007 |
| JP | 2008-003412 | | | 1/2008 |
| JP | 2008-134484 | A | | 6/2008 |
| JP | 2008-139396 | A | | 6/2008 |
| JP | 2008-250034 | | | 10/2008 |

OTHER PUBLICATIONS

International Search Report for corresponding International Application No. PCT/JP2010/068719 dated Dec. 7, 2010.

International Preliminary Report on Patentability for corresponding International Application No. PCT/JP2010/068719 dated May 15, 2012.

* cited by examiner

IMAGE FORMING APPARATUS

TECHNICAL FIELD

The present invention relates to an image forming apparatus such as a copier, printer, facsimile machine and the like using electrophotography, in particular, relating to an image forming apparatus which cools the paper heated by a fixing portion.

BACKGROUND ART

In an image forming apparatus using electrophotography, a toner image formed on a photoreceptor is transferred to paper at a transfer portion. The paper with a toner image transferred thereon is conveyed to a fixing portion and heated and pressed in this fixing portion, whereby the toner image is fixed to the paper. Thereafter, the paper is discharged from a paper discharge portion to a paper output tray and sheets of paper are stacked on the paper output tray.

However, if the paper is discharged as it is without being cooled, the sheets of paper stacked on the paper output tray are not cooled sufficiently, so that there occurs a phenomenon that the facing surfaces of the sheets stacked on the paper output tray are made to stick to each other by the toner (which will be referred to hereinbelow as a sticking phenomenon) because the paper is high in temperature. This sticking phenomenon is markedly conspicuous in duplex printing, fast printing and printing using a low melting point toner.

In order to alleviate this sticking phenomenon, there is a method whereby the length of the conveying path from the fixing portion to the paper output tray is made long so as to gain time for cooling. However, with recent development for miniaturization of image forming apparatuses, this method has become unable to be adopted.

For this reason, a scheme is adopted in which the paper after passage of the fixing portion is cooled by blowing air while it is being conveyed by pairs of conveying rollers in the conveying path. In the image forming apparatuses described in patent document 1 and patent document 2, air blowing on the paper being conveyed and exhaustion of blown air from the conveying path are carried out in the duplex printing paper path or in the paper path directly after fixing.

PRIOR ART DOCUMENTS

Patent Documents

Patent Document 1:
Japanese Patent Application Laid-open 2002-62702
Patent Document 2:
Japanese Patent Application Laid-open 2006-267479

SUMMARY OF THE INVENTION

Problems to be Solved by the Invention

However, in the image forming apparatuses described in patent document 1 and patent document 2, when the paper is cooled in the duplex printing paper path, the paper that is discharged without passing through the duplex printing path cannot be cooled, so that it is necessary to cool the paper also in the paper path directly after fixing. Further, if the paper is cooled through the conveying path directly after fixing, airflow is created near the fixing device so that the flow of air around the fixing device is affected, resulting in use of waste power to keep the temperature of the fixing portion.

The present invention has been devised in view of the above circumstances, it is therefore an object of the present invention to provide an image forming apparatus in which air is blown to the paper in the conveying path so as to cool the paper early to thereby prevent occurrence of the sticking phenomenon on the paper output tray while the air blowing onto the paper in the conveying path is prevented from causing any reduction of the fixing device in temperature and hence using any waste power to keep the temperature of the fixing portion.

Means for Solving the Problems

An image forming apparatus of the present invention includes an image forming portion for forming an image on a recording medium and a fixing portion for thermally fixing the image onto the recording medium after image forming, comprising: a proximate post-fixing conveying path for conveying a recording medium directly after thermal fixing by the fixing portion; an output conveying path joined to the proximate post-fixing conveying path for conveying a recording medium to an output port or switching back a recording medium; a duplex conveying path jointed to the output conveying path at the junction with the proximate post-fixing conveying path for performing duplex printing of the recording medium switched back by the output conveying path; a cooling mechanism having a blowoff port for sending a cooling air; and an exhausting mechanism having a suction port that suctions and discharges the cooling air, and is characterized in that the blowoff port and the suction port are arranged on, at least, the same surface conveyance side in either the output conveying path and the duplex conveying path, either one of the blowoff port and the suction port is positioned opposing the output conveying path, and the other suction port is positioned opposing the output conveying path, the duplex conveying path or the junction of the output conveying path and the duplex conveying path, or the other blowoff port is positioned opposing the output conveying path or the duplex conveying path.

The image forming apparatus is characterized in that blowoff port and the suction port are arranged on the same surface conveyance side opposite to the side to which the proximate post-fixing conveying path joins.

In this way, both the paper to be output and the paper to be sent to the duplex conveying path can be cooled by a single cooling mechanism, thus realizing miniaturization of the image forming apparatus. Further, the blowoff port and the suction port are arranged on, at least, the same surface of the output conveying path and the duplex conveying path to create airflow and suppress flow-in of cooling wind to the proximate post-fixing conveying path, whereby it is possible to avoid consumption of waste power to keep the temperature of the fixing unit.

The image forming apparatus is characterized in that the blowoff port is laid out in a position distant from the conveying roller nearest to the junction, among the conveying rollers arranged along the conveying path in which the blowoff port are positioned.

In this way, the blowoff port is arranged at a distance from the junction so as to suppress the cooling wind from flowing into the proximate post-fixing conveying path, it is hence possible to avoid consumption of waste power to kept the temperature of the fixing portion.

The image forming apparatus is characterized in that the proximate post-fixing conveying path extends approximately vertically from the fixing portion, and the output conveying path and the duplex conveying path are arranged approximately horizontally and joined to the proximate post-fixing conveying path.

In this way, since heat from the fixing portion rises from the proximate post-fixing conveying path, it is possible to suppress flow-in of cooling wind to the proximate post-fixing conveying path more efficiently, whereby it is possible to avoid consumption of waste power to keep the temperature of the fixing portion.

The image forming apparatus is characterized in that the output conveying path has a predetermined length of a flat portion, between the junction with the proximate post-fixing conveying path and the blowoff port of the cooling mechanism.

In this way, the blowoff port is arranged at a distance from the junction so as to suppress the cooling wind from flowing into the proximate post-fixing conveying path, it is hence possible to avoid consumption of waste power to kept the temperature of the fixing portion.

Effect of the Invention

According to the present invention, since the paper is cooled by blowing air from the cooling mechanism while the air blown to the paper is exhausted by the exhausting mechanism, the air blow to the paper is unlikely to flow into the periphery of the fixing portion. Accordingly, it is possible to avoid consumption of waste power to keep the temperature of the fixing portion and discharge heat from the fixing portion at the same time.

BRIEF DESCRIPTION OF THE DRAWINGS

FIGS. 8-1, 8-2, 8-3 A flow chart showing the sequential steps of cooling the paper.

MODES FOR CARRYING OUT THE INVENTION

Next, the embodied modes of the present invention will be described with reference to the accompanying drawings. The embodied modes hereinbelow are mere exemplary embodiments of the present invention, hence will not specify the technical scope of the present invention.

Figure 1:
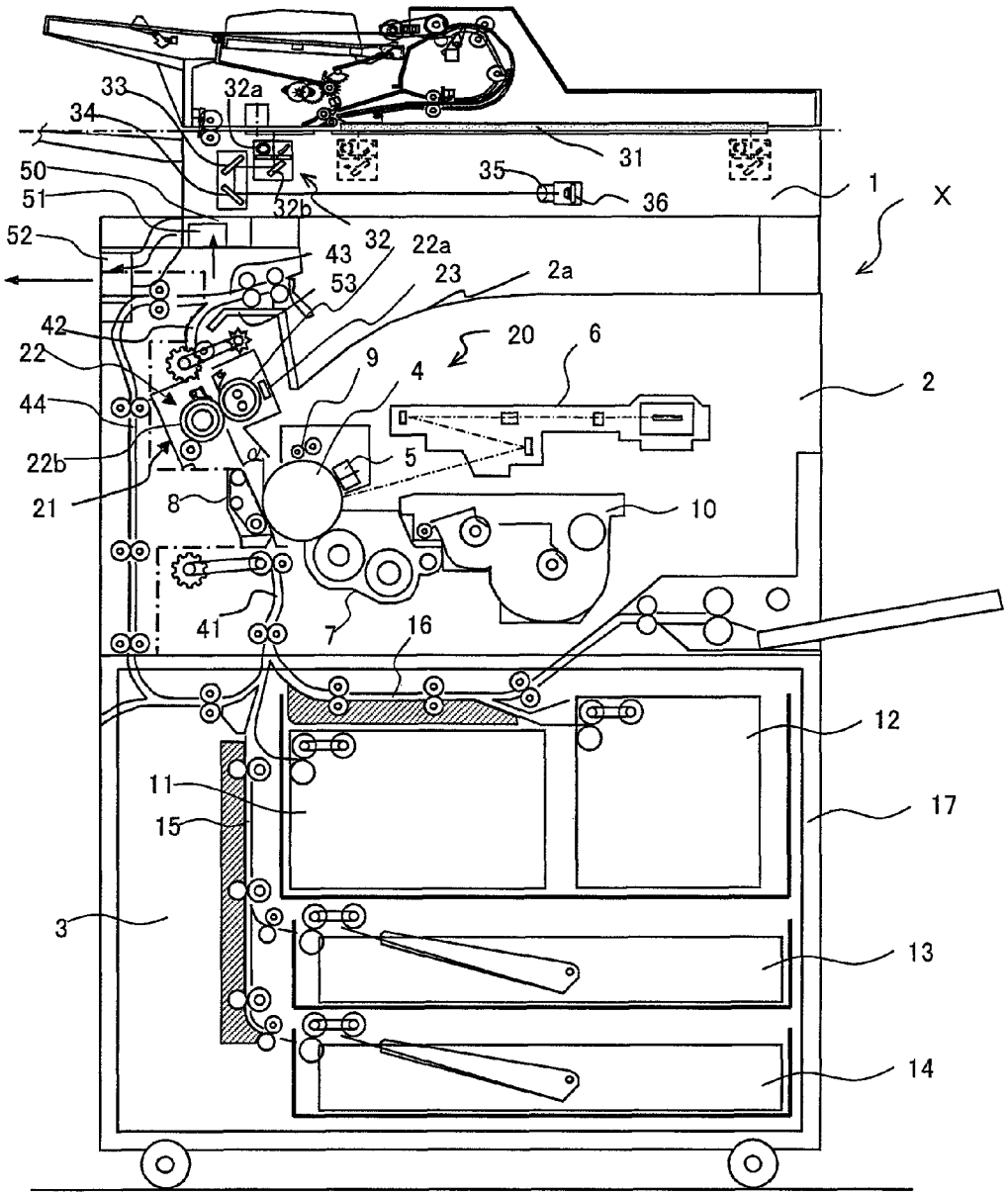
FIG. 1 A schematic sectional diagram showing a configuration of an image forming apparatus according to an embodied mode of the present invention.

Herein, FIG. 1 is a schematic sectional diagram showing a configuration of an image forming apparatus X according to the embodied mode of the present invention.

To being with, a configuration of image forming apparatus X according to the one embodiment of the present invention will be described. Image forming apparatus X is a multi-functional machine having both copier and printer and functions.

This image forming apparatus X includes a copier mode (copying mode), a printer mode and a FAX mode as printing mode, and a controller (controller 101 described later in FIG. 7) not illustrated in FIG. 1 selects one printing mode in accordance with the control input from an unillustrated operation unit, or reception of a print job from an external host machine such as a personal computer or the like.

As shown in FIG. 1, the image forming apparatus X is broadly comprised of a document reader 1 at the top, a printer portion (image forming portion) 2 arranged therebelow and a paper feed unit portion 3 arranged thereunder.

Document reader 1 starts a copying operation when the start key on a control panel (not shown) arranged on the front side of the housing of the apparatus is operated after input of condition input keys (the number of printing, print magnification and the like) through the control panel, to read an image of the document placed on a glass platen 31. That is, a copy lamp 32*a* (light source) of a copy lamp unit 32 is turned on while copy lamp unit 32 is moved horizontally so as to start irradiation on the document with light. The light irradiated on the document by copy lamp 32*a* is reflected from the document in the form of reflected light containing image information of the document, and the reflected light propagates from a first mirror 32*b* provided in copy lamp unit 32 through a second mirror 33, third mirror 34 and optical lens 35 to be input to, and picked up by, a CCD 36.

The thus read image information is converted from light image information into electric signals by means of a CCD circuit included in the unillustrated controller, and the image information signal is image processed under set conditions and the resultant is transmitted as print data to light scanning unit 6.

Printer portion 2 includes an electrophotographic processor 20 for performing image forming on a recording medium (paper) with a developer (toner), a fixing unit 21 (fixing portion) for heating and fixing the image (toner image) on the recording medium by nipping the recording medium after image forming, between a pair of fixing rollers 22, or a fixing roller 22*a* (heat roller) and a pressing roller 22*b*. This fixing roller 22*a* incorporates a heater therein. Power supply to this heater is controlled by an unillustrated controller so that the detected temperature of a temperature sensor 23 that detects the temperature of fixing roller 22*a* is kept at a predetermined fixing temperature.

Electrophotographic processor 20 is disposed in the approximate center of printer portion 2, and includes a photoreceptor drum 4 with a charging unit 5, a light scanning unit 6, a developing unit 7, a transfer unit 8 and a cleaning unit 9 arranged therearound.

Charging unit 5 uniformly electrifies the photoreceptor drum 4 surface. Light scanning unit 6 scans a light image on photoreceptor drum 4 that has been uniformly electrified to write an electrostatic latent image. Developing unit 7 visualizes the electrostatic latent image that has been written by light scanning unit 6 in accordance with print data, with a developer.

Transfer unit 8 transfers the recorded and reproduced image on photoreceptor drum 4 to a recording medium such as a recording sheet or the like. Cleaning unit 9 removes the residual developer on photoreceptor drum 4 so as to enable a new image to be recorded on photoreceptor drum 4.

The residual developer removed from this cleaning unit 9 is collected into a developer supply portion 10 of developing unit 7 and recycled. Here, the image forming apparatus according to the present invention is not limited to those including a recycling process for the residual developer, but may be one that collects and discards the residual developer.

Paper feed unit portion 3 includes paper feed trays (recording media suppliers) 11, 12, 13 and 14 to which multiple types of recording media (recording paper etc.) are set. With this configuration, it is possible to accommodate a variety of paper, e.g., different sizes of paper as recording media, in individual paper feed trays 11 to 14, separately.

Paper feed tray 11 and paper feed tray 12 are arranged side by size while paper feed tray 13 is arranged under these and paper feed tray 14 is arranged further below. Here, paper feed tray 13 and paper feed tray 14 are designed so as to have the same capacities. In contrast, paper feed tray 11 and paper feed tray 12 are configured to have greater capacities than paper feed tray 13 and paper feed tray 14.

Paper feed unit portion 3 further includes a fourth conveying path 15 and a fifth conveying path 16 in order to convey the paper (recording mediums) accommodated in paper feed trays 11 to 14 toward printer portion 2. This fourth conveying path 15 conveys the paper stored in paper feed trays 11, 13 and 14 toward printer portion 2 while fifth conveying path 16 conveys the paper stored in paper feed tray 12 toward printer portion 2.

Fourth conveying path 15 extends approximately vertically along a frame 17 of paper feed unit portion 3. On the other hand, fifth conveying path 16 extends approximately horizontally along frame 17. In this way, paper feed trays 11 to 14, fourth conveying path 15 and fifth conveying path 16 are laid out efficiently inside paper feed unit portion 3 so as to realize a space-saving configuration of paper feed unit portion 3.

When paper is set on each of paper feed trays 11 to 14, the target paper feed tray 11 through 14 is drawn out to the front side of the image forming apparatus X and the paper is supplied.

When image forming is carried out on a recording medium in the image forming apparatus X, one tray is selected from paper feed trays 11 to 14, and the paper is separated one sheet at a time and fed from the selected tray.

The paper (recording medium) conveyed (supplied) from paper feed tray 11 through 14, passes through fourth or fifth conveying path 15 or 16, and is conveyed upward through third conveying path 41 to be supplied into and between photoreceptor drum 4 and transfer unit 8. The reproduced image recorded on photoreceptor drum 4 is transferred to the supplied paper by means of transfer unit 8. The paper after image forming is conveyed to fixing unit 21 (fixing portion) arranged further above, whereby the toner image is heated and fixed in the fixing unit 21.

Figure 2:
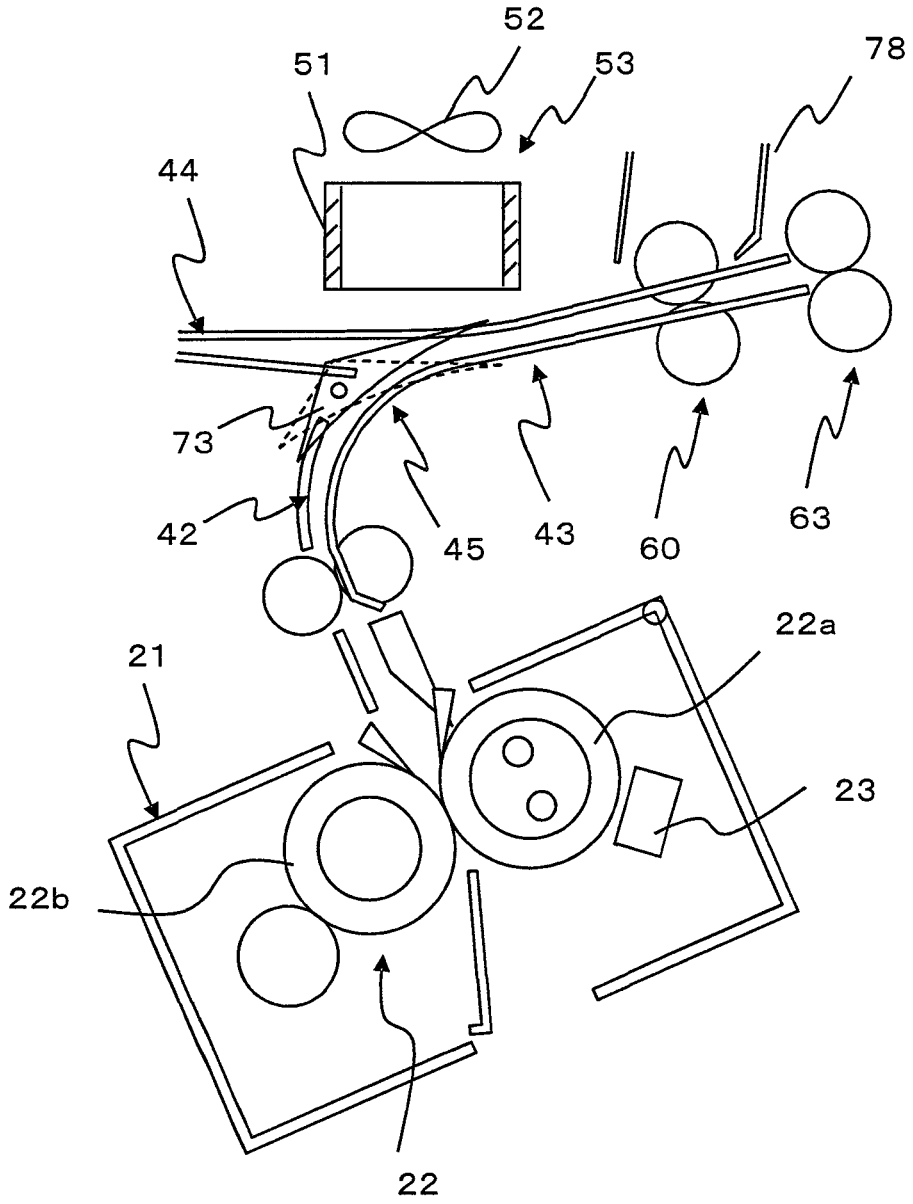
FIG. 2 An enlarged view of a fixing portion of an image forming apparatus and its paper conveying paths.

FIG. 2 is an enlarged diagram of the fixing portion and its paper conveying paths of the image forming apparatus.

The paper after thermal fixing by the fixing unit 21 is delivered out into first conveying path (proximate post-fixing conveying path) 42 and directed further upward. The paper is then conveyed to second conveying path 43 laid out above the fixing unit 21. Second conveying path 43 is an output conveying path and also serves as a switch back conveying path for duplex printing.

Second conveying path 43 is joined at a junction 45 to first conveying path 42 for conveying the paper from fixing unit 21 and to a sixth conveying path 44 for switching back and recirculating the paper to perform printing on the rear side. A gate 73 is rotationally attached to this junction 45 to guide the paper to each conveying path.

The aforementioned second conveying path 43 is a path for conveying the paper having passed through the first conveying path 42 (the paper after thermal fixing) by making a turn in an approximately horizontal direction, and this makes the paper be discharged to paper output tray 2*a* outside the apparatus, be sent out to a post-processor (not shown), or be switched back and recirculated to sixth conveying path (duplex conveying path) 44 to thereby achieve image forming on both sides of the paper.

When the apparatus is a type that performs thermal fixing whilst conveying the paper upward as in the subject image forming apparatus X, heated air given off from the fixing unit 21 also rises as the paper goes upward (is conveyed upward), so that the paper after thermal fixing is unlikely to be cooled. Further, the stopping position of the copy lamp unit 32 in the document reader 1 (one example of the image reading means) is disposed over the first conveying path 42 and second conveying path 43 (i.e., over the fixing unit 21), hence is readily to reach an abnormally high temperature as the heated air from the fixing unit 21 rises, and this will cause breakdown of the copy lamp unit 32.

To deal with this, the subject image forming apparatus X is configured such that an exhausting duct 51 is laid out between the second conveying path 43 and the position (stopping position) of the copy lamp unit 32 of the document reader 1 to thereby forcibly exhaust the air over the second conveying path 43 through the duct. Specifically, the air over the second conveying path 43 is guided by the exhausting duct 51 from its lower opening to the side (the flank on the left as one faces FIG. 1) of image forming apparatus X, and exhausted by force by an exhausting fan 52 arranged on that flank (the exhausting duct 51 and the exhausting fan 52 are one example of the aforementioned exhausting means).

Here, the aforementioned exhausting duct 51 is formed by a supporting member 50 for supporting the document reader 1 (image reading means).

Since the aforementioned exhausting duct 51 is laid out opposing the fixing unit 21 across the second conveying path 43, the second conveying path 43 and the paper passing therethrough play a role of a protective shield against moving air around the fixing unit 21. Hence, compared to the case where the exhausting duct is arranged near the fixing unit 21 as in the prior art, this arrangement will not deprive (cool) the fixing unit 21 of heat more than necessary and will not increase power consumption of (the thermal heater of) the fixing unit 21 to keep the fixing temperature.

Here, the aforementioned exhausting duct 51 in the embodied mode should not be limited to the position depicted in FIG. 1 and FIG. 2, as will be described later.

Second conveying path 43 and sixth conveying path 44 include a cooling mechanism for cooling the paper and an exhausting mechanism. Now, details will be given.

The 1st Embodiment

Figure 3:
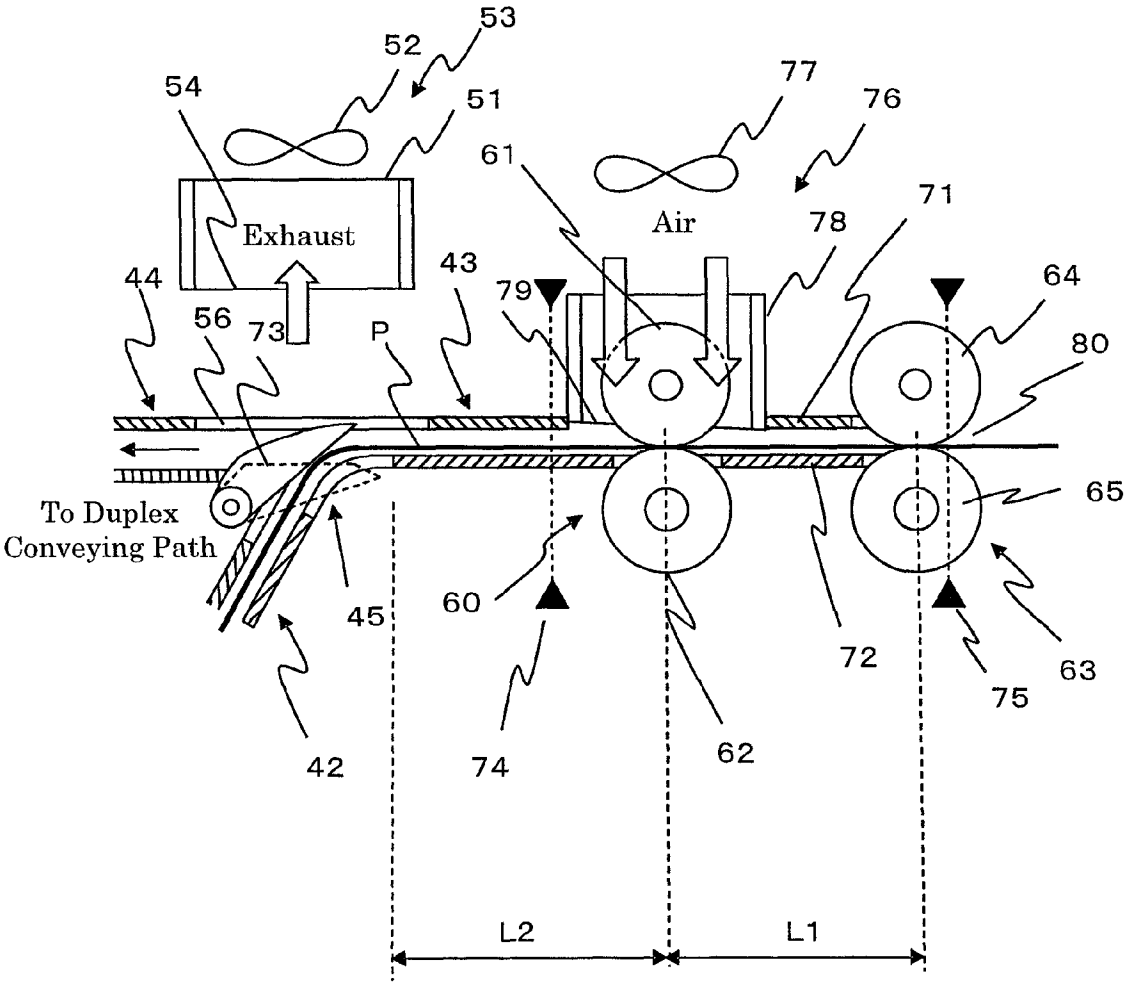
FIG. 3 A configurational diagram showing the first embodiment in which a cooling mechanism and an exhausting mechanism are arranged in conveying paths.
Figure 4:
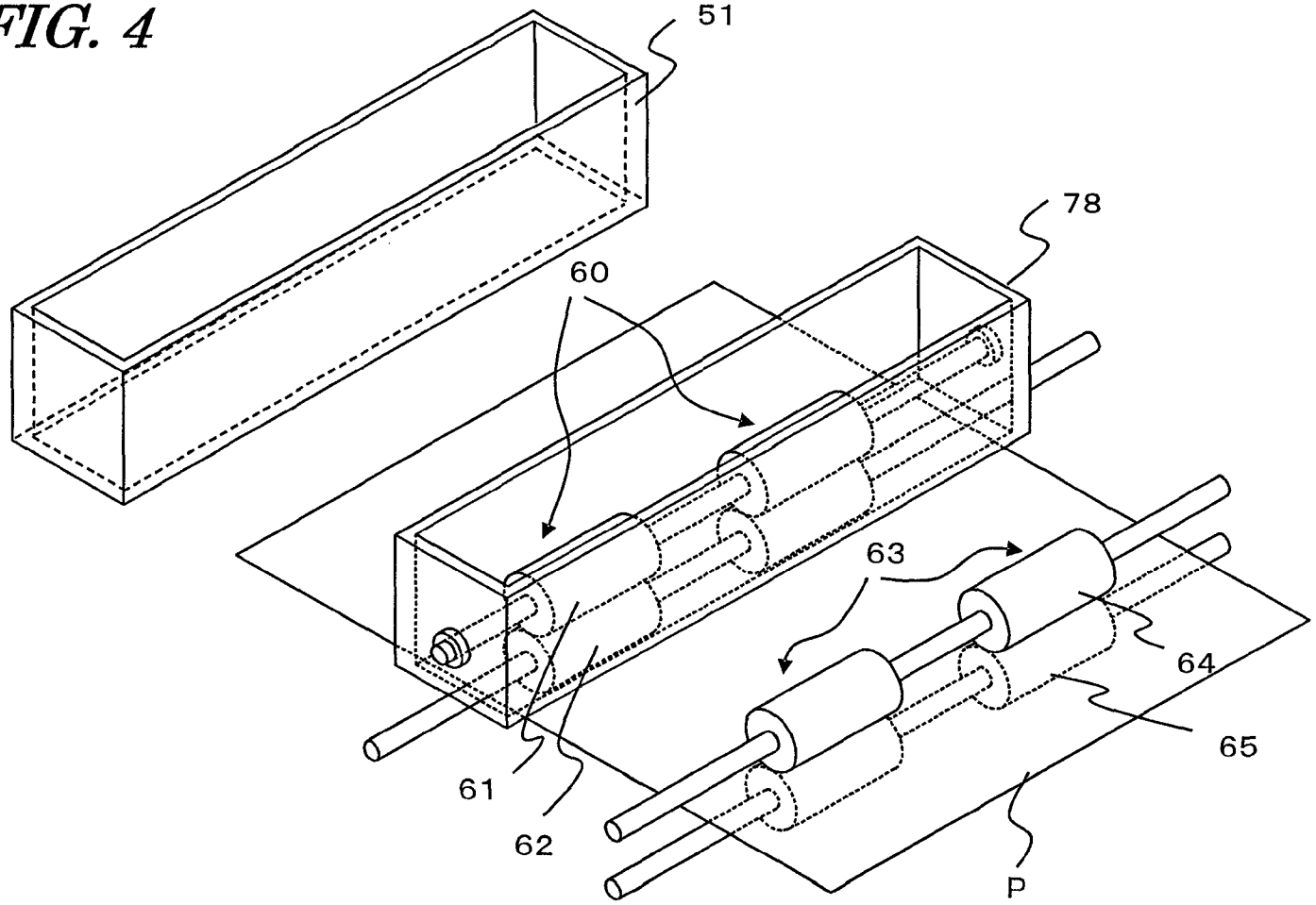
FIG. 4 A perspective view showing the first embodiment in which a cooling duct and an exhausting duct are arranged in conveying paths.
Figure 5:
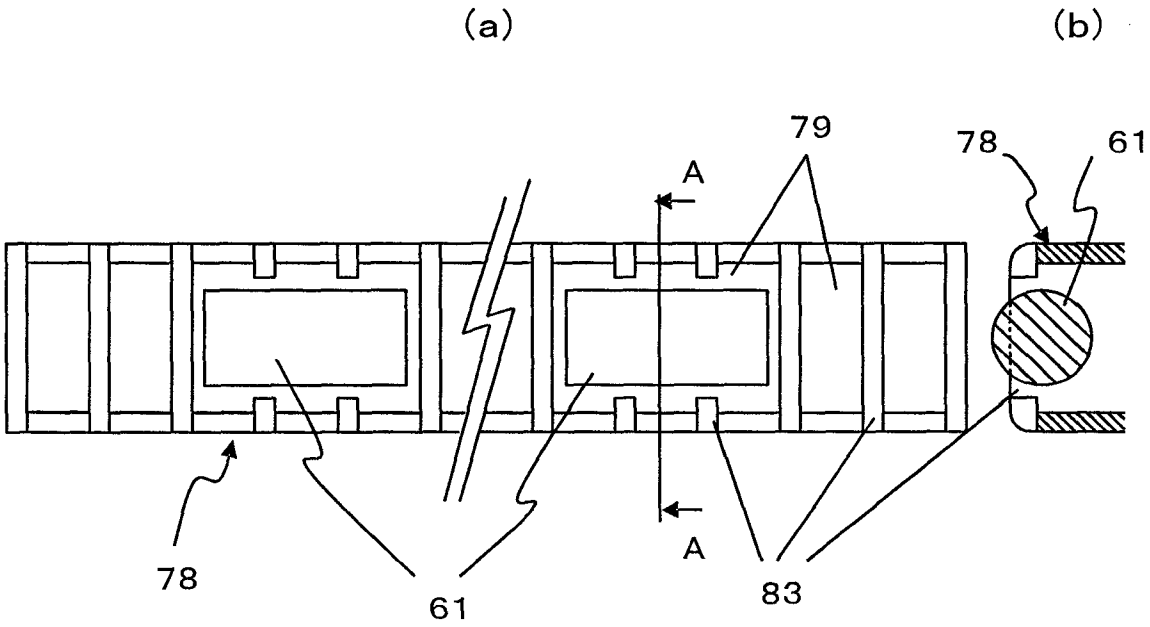
FIG. 5 A diagram showing a cooling duct of the first embodiment, (a) a plan view and (b) a sectional view cut on A-A.
Figure 6:
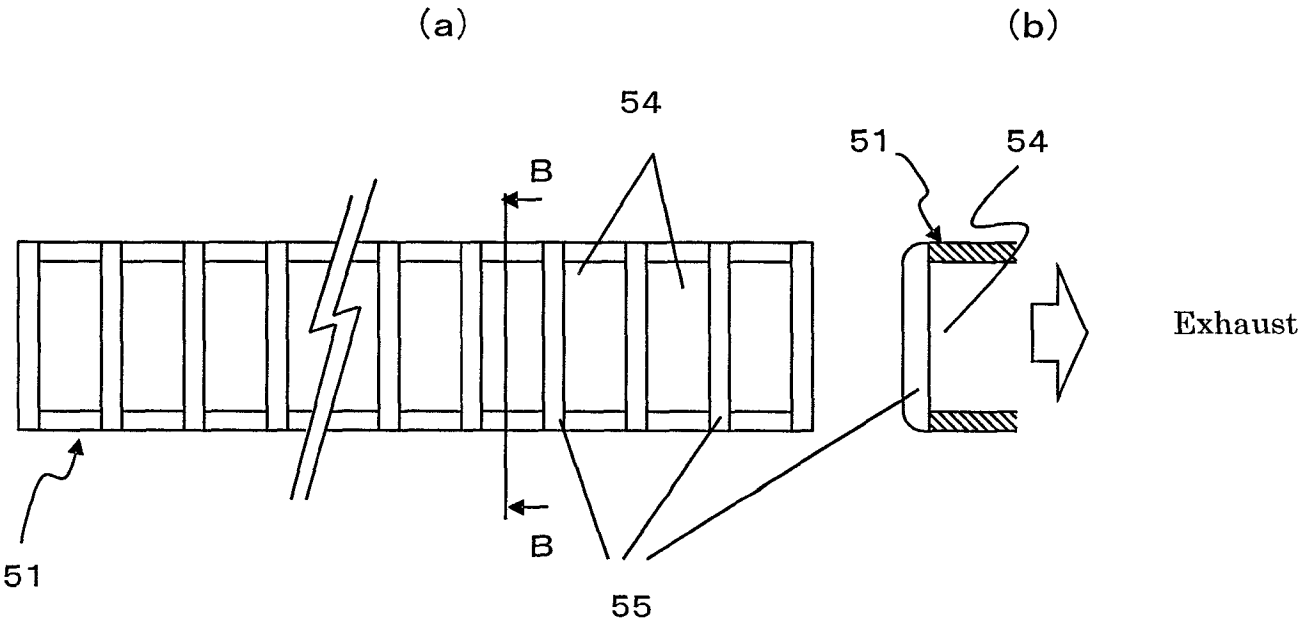
FIG. 6 A diagram showing an exhausting duct of the first embodiment, (a) a plan view and (b) a sectional view cut on B-B.

FIG. 3 is a configurational diagram showing the first embodiment in which a cooling mechanism and an exhausting mechanism are arranged in conveying paths; FIG. 4 is a perspective view showing the first embodiment in which a cooling duct and an exhausting duct are arranged in the conveying paths; FIG. 5 is a diagram showing a cooling duct of the first embodiment; FIG. 6 is a diagram showing an exhausting duct of the first embodiment; FIG. 5(*a*) is a plan view of the cooling duct and FIG. 5(*b*) is a sectional view cut on A-A; and; FIG. 6(*a*) is a plan view of the exhausting duct and FIG. 6(*b*) is a sectional view cut on B-B.

Each of conveying paths 42, 43 and 44 is formed of an upper conveying guide and a lower conveying guide 72, and paper P is conveyed between upper conveying guide 71 and lower conveying guide 72. Second conveying path 43 is provided with a first conveying roller pair 60 and second conveying roller pair 63 arranged a predetermined distance apart, and a paper output port 80 is located ahead of second conveying roller pair 63. The distance L1 between the nip of the first conveying roller pair 60 and the nip of second conveying roller pair 63 is designed to be shorter than the shortest paper length of the paper to be used. First conveying roller pair 60 is formed of an upper driven roller 61 and a lower drive roller 62 while second conveying roller pair 63 is formed of an upper driven roller 64 and a lower drive roller 65. As shown in FIG. 4, first conveying roller pair 60 and second conveying rollers 63 are each formed of two roller sections with respect to the direction of the rotational axis (paper width direction). Paper P is held between driven rollers 61 and 64 and drive rollers 62 and 65 and is conveyed to output port 80 by rotational drive of drive rollers 62 and 65.

As shown in FIG. 3, an approximately horizontal flat portion of at least a predetermined length L2 is provided from junction 45 between first conveying path 42 and second conveying path 43 to a cooling duct 78 that encloses first conveying roller pair 60. This is to make the cooling wind flow easily along second conveying path 43 toward sixth conveying path 44 to thereby improve the cooling effect on the conveyed paper.

Further, as described with FIG. 2, second conveying path 43 is joined at junction 45 to first conveying path 42 for conveying the paper from fixing unit 21 and to sixth conveying path 44 for switching back and recirculating the paper to perform printing on the rear side of the paper. Further, gate 73 is attached to this junction 45. As shown in FIG. 3 gate 73 is attached in a pivotal manner and rotates upwards so as to establish communication between conveying path 42 and conveying path 43 (this position of gate 73 will be called the first position) and rotates downwards so as to establish communication between conveying path 43 and conveying path 44 (this position of gate 73 will be called the second position), to thereby become able to guide the paper.

A first paper sensor 74 is provided on the junction 45 side of first conveying roller pair 60 while a second paper sensor 75 is provided on the output port 80 side of second conveying roller pair 63. These paper sensors 74 and 75 include a light emitter and light received arranged at top and bottom across second conveying path 43 so as to detect presence or absence of the paper inside the conveying path. First paper sensor 74 shares the function of the timing sensor for switching back the paper. Second paper sensor 75 detects the rear end of the conveyed paper, to thereby detect the end of paper discharge.

Here, the paper sensors may be a sensor that uses another detection technique such as an actuator type etc.

Second conveying path 43 is arranged with cooling duct 78 of a cooling mechanism 76 while exhausting duct 51 of an exhausting mechanism 53 is arranged at junction 45. A blowoff port 79 of cooling duct 78 and a suction port 54 of exhausting duct 51 are arranged on the same conveyance surface side and each positioned so as to oppose the conveying path.

In this embodiment mode, blowoff port 79 of cooling duct 78 and suction port 54 of exhausting duct 51 are located on the second conveying path 43's conveyance surface side (the upper side of upper conveying guide 71 in FIG. 3) on the opposite side from the side on which first conveying path 42 joins to second conveying path 43.

Here, blowoff port 79 of cooling duct 78 and suction port 54 of exhausting duct 51 may be located on the same conveyance surface side (the lower side of lower conveying guide 72 of second conveying path 43 in FIG. 3) as the side on which first conveying path 42 joins to the second conveying path.

A cooling fan 77 of cooling mechanism 76 and an exhausting fan 52 of exhausting mechanism 53 may be arranged at any places as long as they can blow or exhaust air from cooling duct 78 and exhausting duct 51. Also, the extended positions and shapes of cooling duct 51 and exhausting duct 78 should not be limited to the description below.

Cooling duct 78 is arranged so as to enclose driven roller 61 of first conveying roller pair 60 to guide air from without to the paper P being conveyed. As shown in FIGS. 4 and 5, cooling duct 78 is a rectangular-shaped frame having a width in which driven roller 61 is accommodated, and having a length that can cool the full width of the paper (the paper width in the direction perpendicular to the conveying direction). As shown in FIG. 5, cooling duct 78 has a configuration in which ribs 83 are formed in the direction of conveyance to define openings at intervals to form blowoff port 79. Ribs 83 also serve as conveying guides. Further, driven rollers 61 are rotatably and integrally supported on cooling duct 78, providing a simple configuration. As shown in FIG. 3, upper conveying guide 71 is made open at the portions where driven rollers 61 of first conveying roller pair 60 are arranged. Cooling wind guided by cooling doctor 78 is fed through these openings to thereby cool the paper held between first conveying roller pair 60. Air is taken in from the outside of the apparatus and sent to cooling duct 78 by cooling fan 77.

On the other hand, suction port 45 of exhausting duct 51 of exhausting mechanism 53 is arranged over junction 45 at which first conveying path 42 is joined to second conveying path 43 so as to oppose second conveying path 43. This exhausting mechanism 53 is made up of exhausting duct 51 and exhausting fan 52, as has been illustrated with FIGS. 1 and 2. Exhausting duct 51 has a configuration in which ribs 55 are formed in the direction of conveyance to define openings at intervals to form suction port 54. Ribs 55 also serve as conveying guides.

Here, suction port 54 of exhausting duct 51 may be arranged over the flat portion of a predetermined length L2 of second conveying path 43 so as to oppose second conveying path 43. An opening portion is formed in conveying guide 71 under exhausting duct 51 to form a ventilation portion 56 for sending air from the conveying path to the exhausting duct.

Figure 7:
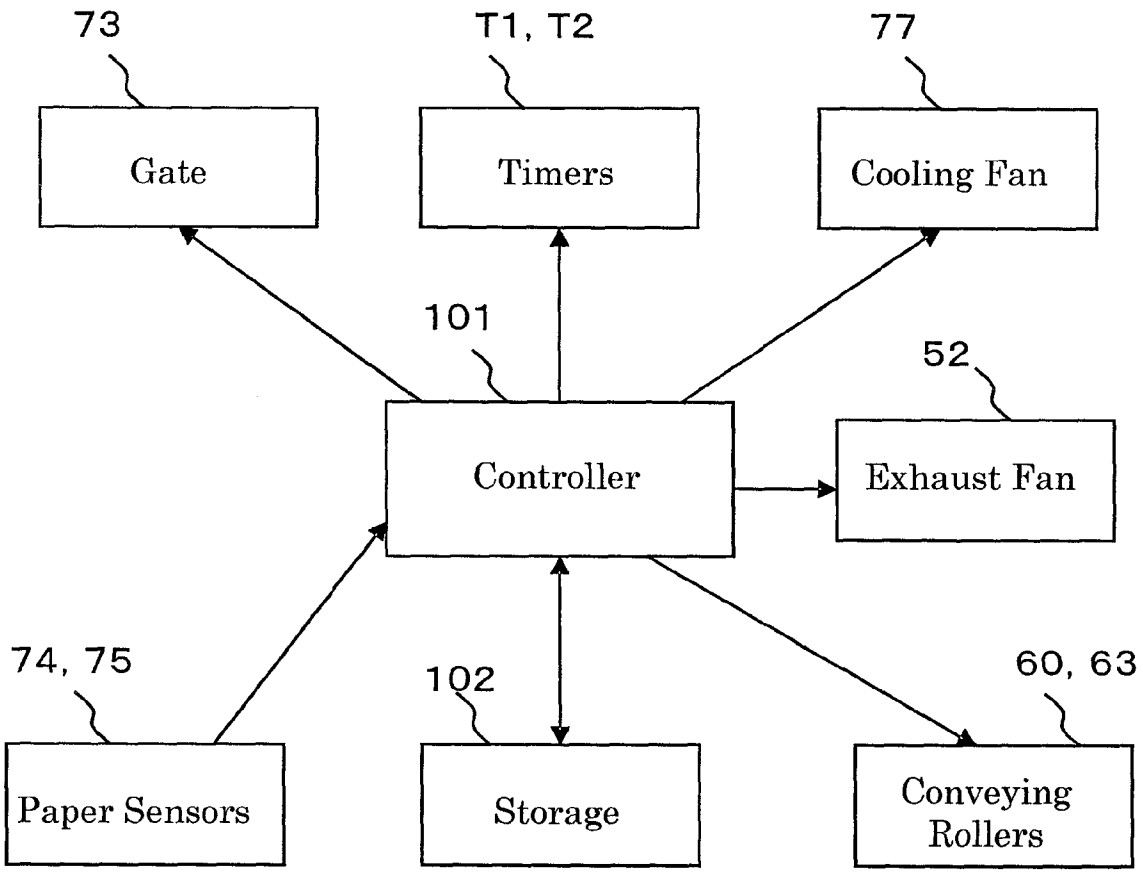
FIG. 7 A block diagram relating to a cooling mechanism and an exhausting mechanism of an image forming apparatus.

FIG. 7 is a block diagram relating to the cooling mechanism and exhausting mechanism of the image forming apparatus. As described above, the image forming apparatus is controlled by controller 101. That is, controller 101 controls conveying roller pairs 60 and 63, paper sensors 74 and 75, gate 73, cooling fan 77, exhausting fan 52, in accordance with the detected values from paper sensors 74 and 75 and settings previously registered in a storage 102. The controller also sets up timers T1 and T2 described later.

The cooling operation by the cooling mechanism and the exhausting operation by the exhausting mechanism will be described next.

Figures 1, 8:
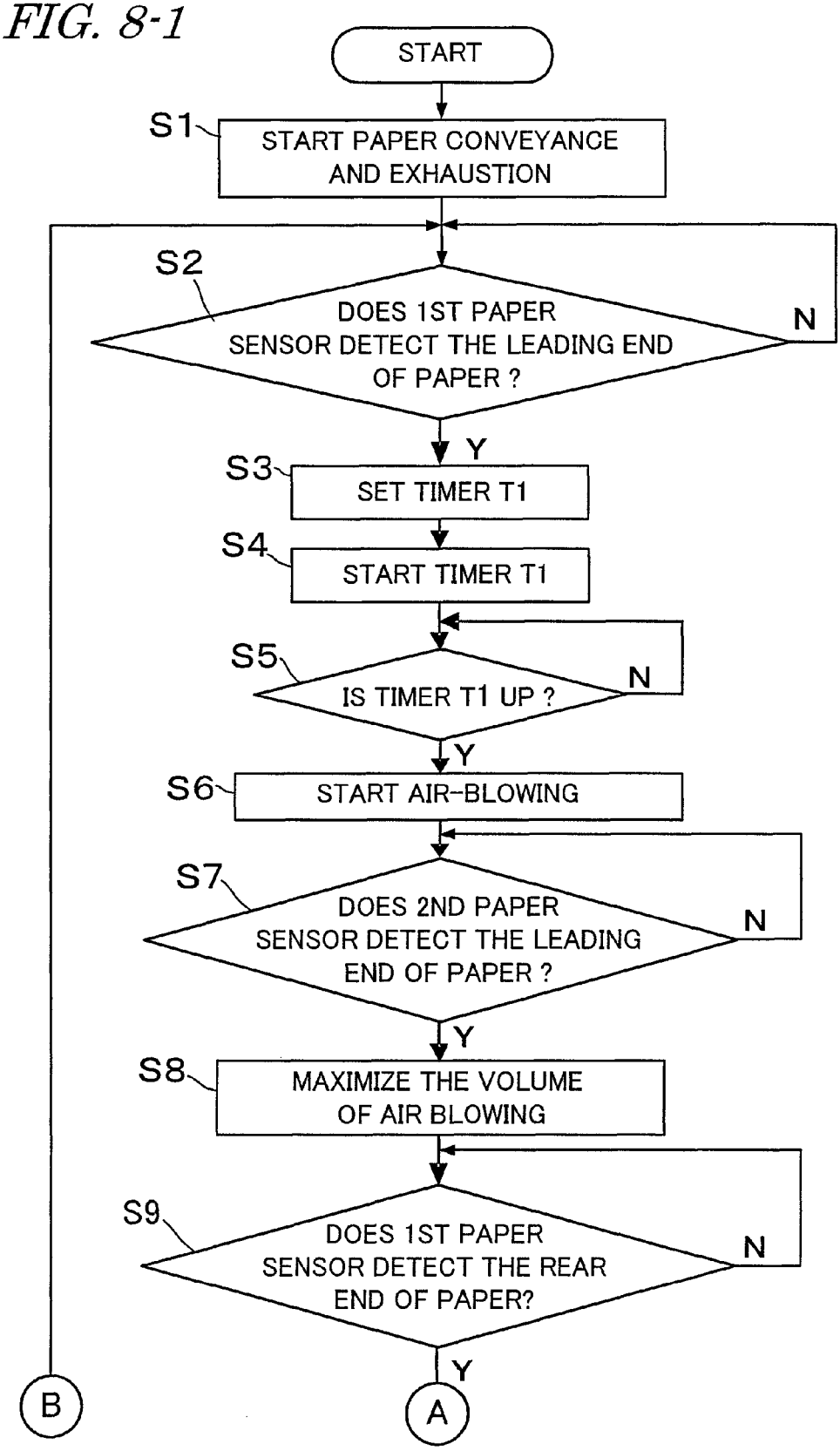
Figures 2, 8:
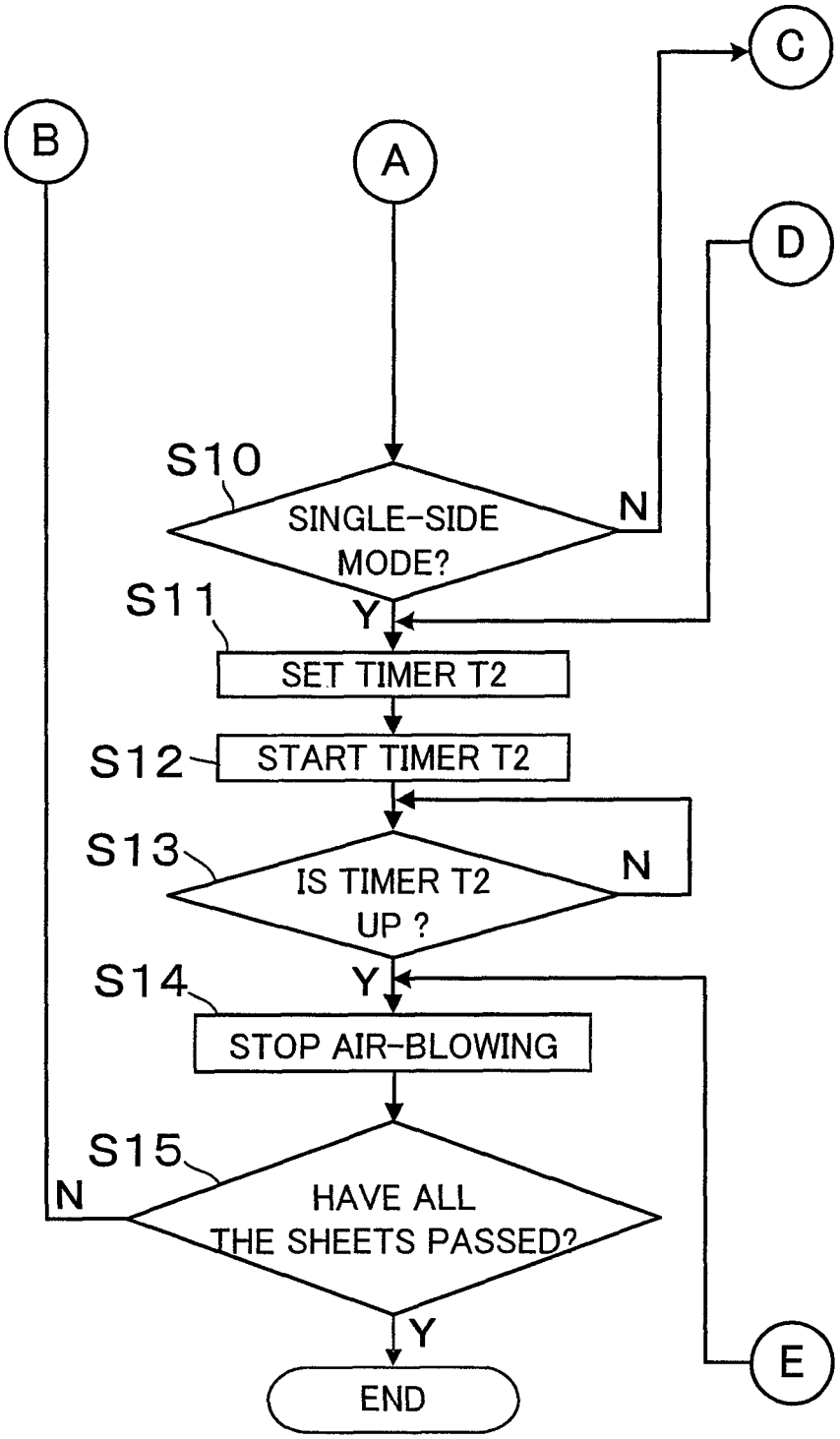
Figures 3, 8:
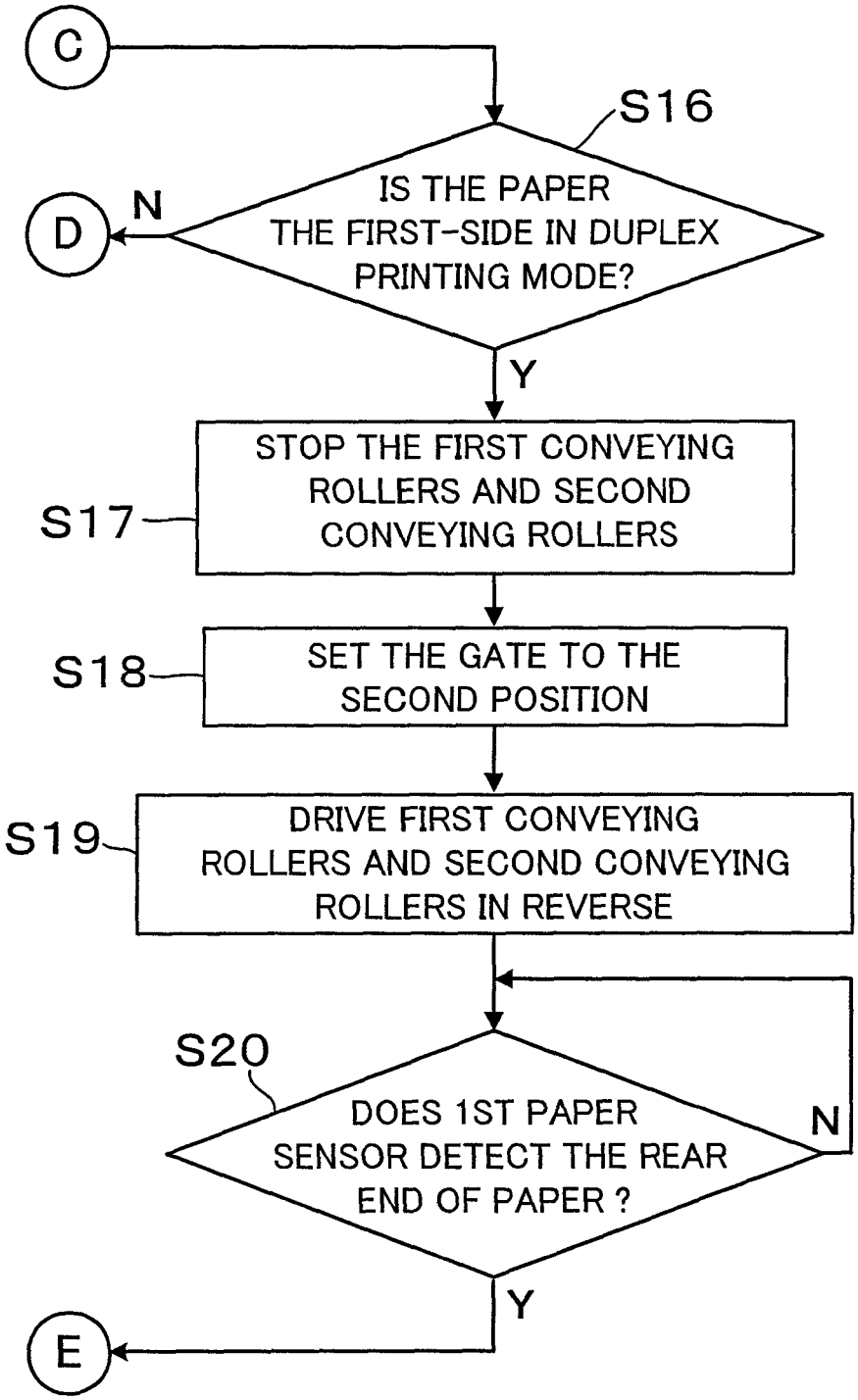
Figure 9:
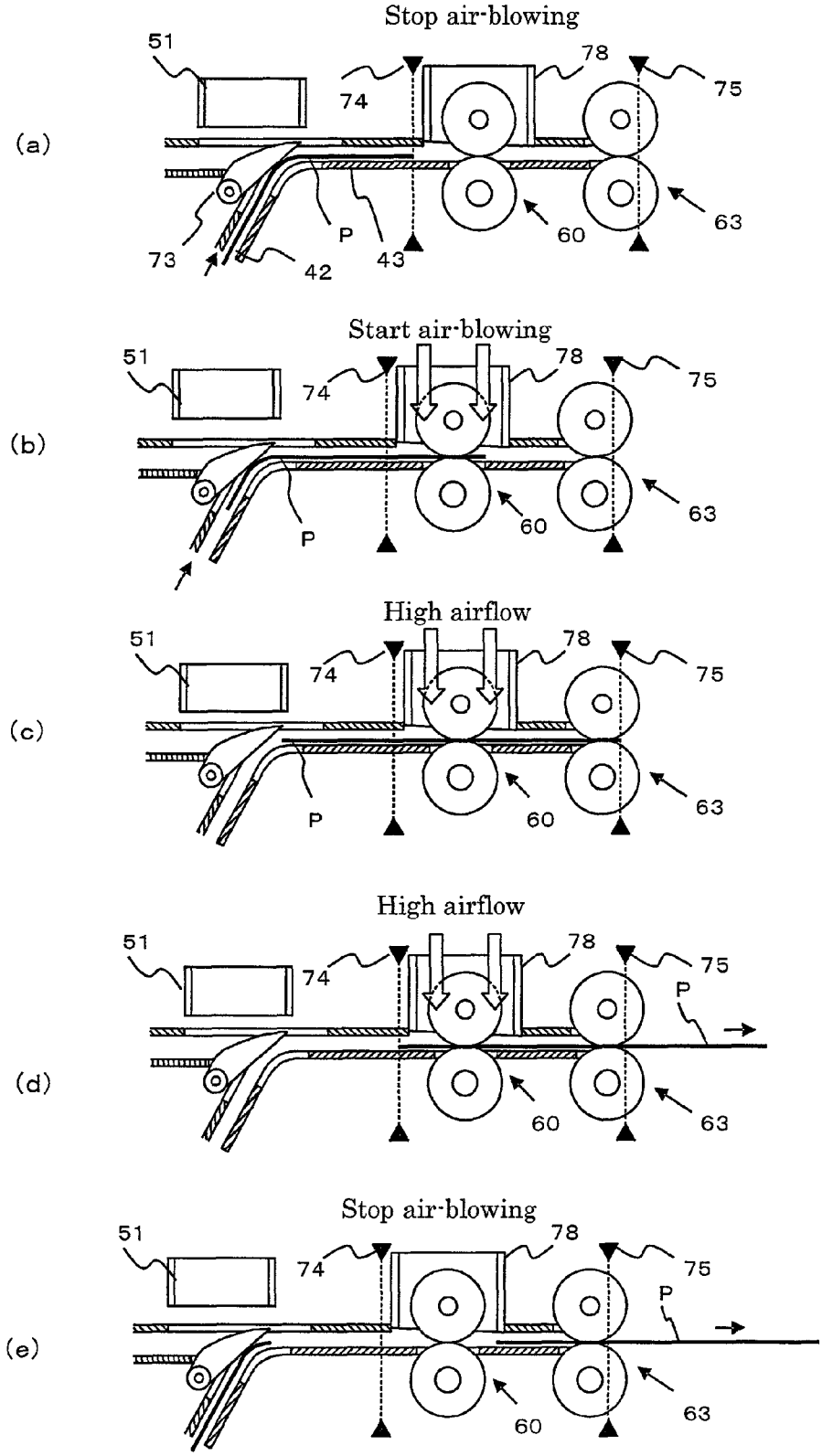
FIG. 9 An illustrative diagram showing paper conveyance and cooling in the single-side printing mode or when two-side printing has been completed in duplex printing mode.
Figure 10:
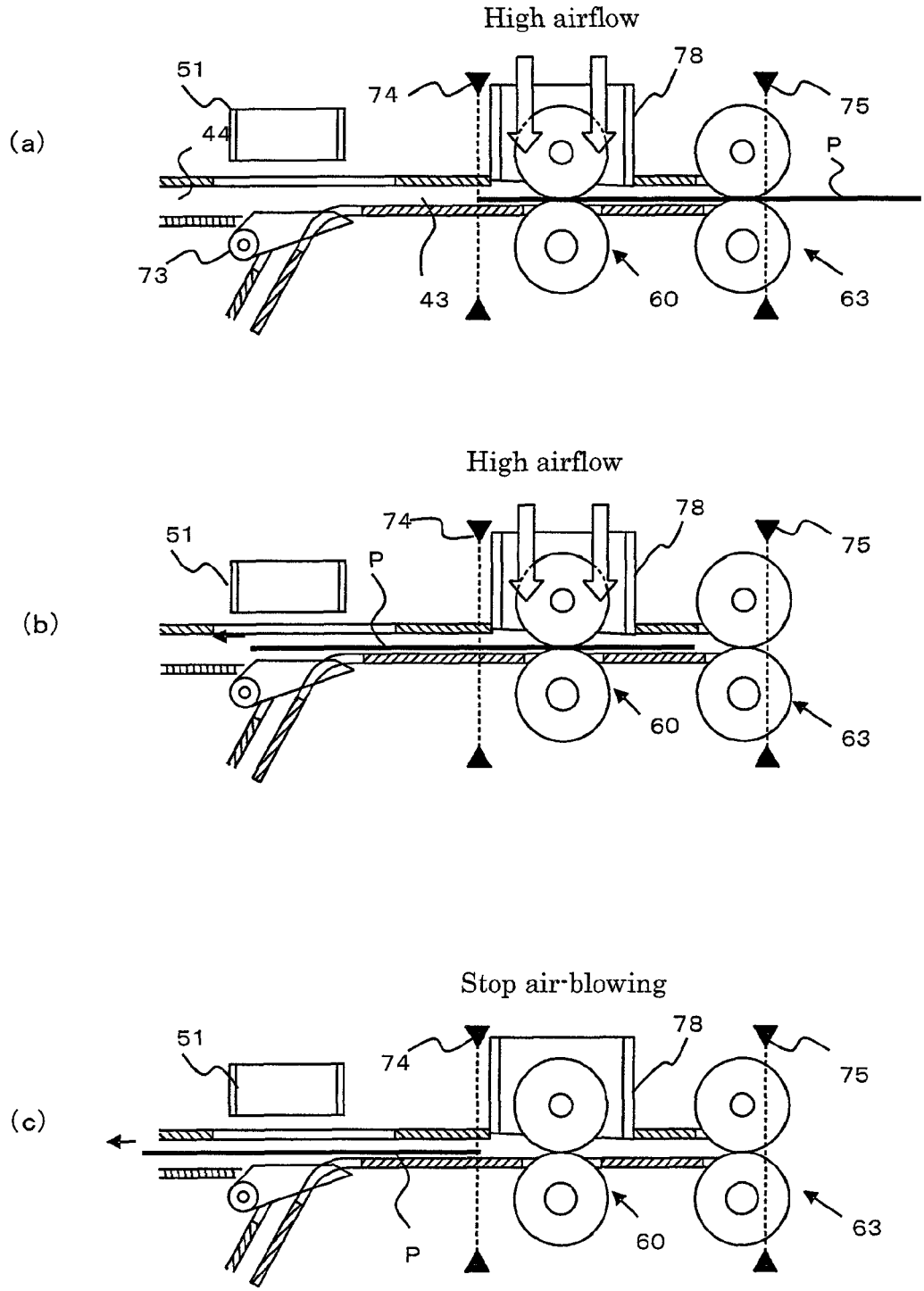
FIG. 10 An illustrative diagram showing paper conveyance and cooling in a case of one side printing in duplex printing mode.

FIG. 8 is a flow chart showing the sequential steps of cooling the paper; FIG. 9 is an illustrative diagram showing paper conveyance and cooling in single-side printing mode or when duplex printing has been completed in duplex printing mode. FIG. 10 is an illustrative diagram showing paper conveyance and cooling in a case of one side printing in duplex printing mode.

As shown in FIG. 9(*a*), upon starting paper conveyance, controller 101 turns gate 73 upward to the first position to close sixth conveying path 44 and establish communication between first conveying path 42 and second conveying path 43, whereby the paper having passed through fixing unit 21 starts to be conveyed from first conveying path 42 to second conveying path 43 (Step S1). At the same time, controller 101 also drives exhausting fan 52 to start exhaustion. When first paper sensor 74 detects the leading end of the paper (Step S2; Yes), controller 101 receiving the detected signal sets a timer T1 (Step S3). Since first paper sensor 74 is arranged upstream of the nip of first conveying roller pair 60 and outside cooling doctor 78, the time for the leading end of the paper to enter the nip of first conveying roller pair 60 is set as timer T1. The set value of timer T1 has been registered beforehand in storage 102, and controller 101 sets timer T1 by reading the registered value from storage 102.

Timer T1 is started (Step S4), and timer T1 counts up to the set value (predetermined time) (Step S5; Yes), controller 101 starts rotating cooling fan 77 at a predetermined rotational rate to start ventilation in a predetermined volume of cooling air, as FIG. 9 (*b*) (Step S6). The set value such as a rotational rate of cooling fan 77 for securing a volume of cooling air in this case has been recorded beforehand in storage 102, and controller 101 reads out this value and drives cooling fan 77.

Since air blowing starts with the paper held by first conveying roller pair 60, the paper is unlikely to be turned up by air blowing when the paper is held by the nip of first conveying roller pair 60, hence conveyance failure of the paper can be prevented. The predetermined volume of cooling airflow is a value depending on the type of paper (paper size, paper thickness, paper texture (whether the direction of fabric is parallel or perpendicular to the direction of conveyance, etc.), and correct selection of this prevents conveyance failure of the paper. The settings such as the rotational rate of cooling fan 77 and the likes have been stored beforehand in storage 102, and controller 101 reads out the settings in accordance with the type of paper to drive cooling fan 77. The type of paper, may be input by the user through the control portion when the paper is set into the paper feed tray, or may be detected by a detecting sensor so that controller 101 automatically sets.

Though air blowing is started at this stage in this embodiment, it is possible to send a light wind from the start of paper conveyance. In this case, the volume of cooling airflow will be increased to the predetermined volume when the paper becomes held by first conveying roller pair 60.

As the paper continues to be conveyed, paper P becomes held by both first conveying roller pair 60 and second conveying roller pair 63, as shown in FIG. 9(*c*). Then, controller 101 checks whether second paper sensor 75 has detected the leading end of paper (Step S7). When confirming that the leading end of paper has been detected (Step S7; Yes), controller 101 switches the rotational rate of cooling fan 77 into high speed to further increase the volume of air blowing and maximize the volume of air blowing per unit time (Step S8). In this way, the cooling effect is further enhanced while the paper is held at both first conveying roller pair 60 and second conveying roller pair 63, it is hence possible to convey the paper stably. The rotational rate of cooling fan 77 in this case has been also registered in advance in storage 102, and controller 101 drives cooling fan 77 in accordance with the registered value.

Next as shown in FIG. 9(*d*), controller 101 checks whether first paper sensor 74 has detected the rear end of paper P (Step S9). When the rear end of paper P has been detected (Step S9; Yes), controller 101 checks whether the current printing is in single-side mode (Step S10). If it is in single-side printing mode (Step S10; Yes), timer T2 is set (Step S11). Here, timer T2 is the time until the paper passes through blowoff port 79. Controller 101 starts timer T2 (Step S12) and checks whether timer T2 is up (Step S13). When timer T2 has counted up the set value (Step S13; Yes), the air blowing is suspended because paper P has passed through blowoff port 79, as shown in FIG. 9(*e*) (Step S14).

It is checked whether all the sheets of paper to be printed have passed through blowoff port 79 (Step S15). If all the sheets have passed through blowoff port 79, the control returns to Step S2 to perform conveyance of the remaining sheets of paper P.

On the other hand, when it is determined at Step S10 that the current printing is in single-side mode, it is checked if the paper is one-sided paper P in the duplex printing mode. If the paper is not a one-sided paper P in duplex printing mode, control goes to Step S11 and sets timer T2. If the paper is a one-sided paper Pin duplex printing mode, first conveying roller pair 60 and second conveying roller pair 63 are stopped (Step S17), and gate 73 is turned downwards to the second position as shown in FIG. 10(*a*) (Step S18) so as to establish communication between second conveying path 43 and sixth conveying path 44. Then, as shown in FIG. 10 (*b*), first conveying roller pair 60 and second conveying roller pair 63 are driven in reverse (Step S19). As shown in FIG. 10 (*c*), when controller 101 checks whether first paper sensor 74 has detected the paper rear end (Step S20), and has detected the paper rear end, the control goes to Step S14.

In this way, cooling wind is not blown or a light volume of cooling wind is blown before the leading end of the paper is held by the nip of first conveying roller pair 60, whereas a predetermined volume of cooling air is blown toward the vicinity of the nip of first conveying roller pair 60 or toward first conveying roller pair 60 when the paper has been nipped by first conveying roller pair 60, whereby it is possible to cool the paper whilst preventing occurrence of paper conveyance failure due to turning-up of the paper by the cooling wind. Since the paper after one-side printed in duplex printing mode is cooled during both the periods of the paper being conveyed into the switchback path and conveyed out of the switchback path, it is possible to cool the paper sufficiently while heat will not buildup inside the apparatus.

Cooling wind blown from blowoff port 79 of cooling duct 78 flows horizontally along conveying guides 71 and 72, and passes through ventilation port 56 formed in upper conveying guide 71 over the junction 45 or flat portion and is discharged from suction port 54 of exhausting duct 51. Accordingly, air flows from blowoff port 79 to suction port 54 while the cooling wind is unlikely to flow to the periphery of fixing unit 21 that is located below. As a result, it is possible to avoid consumption of waste power to keep the temperature of fixing unit 21. At the same time, heat rising from fixing unit 21 located below can be discharged so that no heat will build up inside the apparatus.

Further, since heat rises from first conveying path 42 that extends approximately vertically so that cooling air is unlikely to enter through junction 45, it is possible to avoid consumption of waste power to keep the temperature of fixing unit 21.

The 2nd Embodiment

Figure 11:
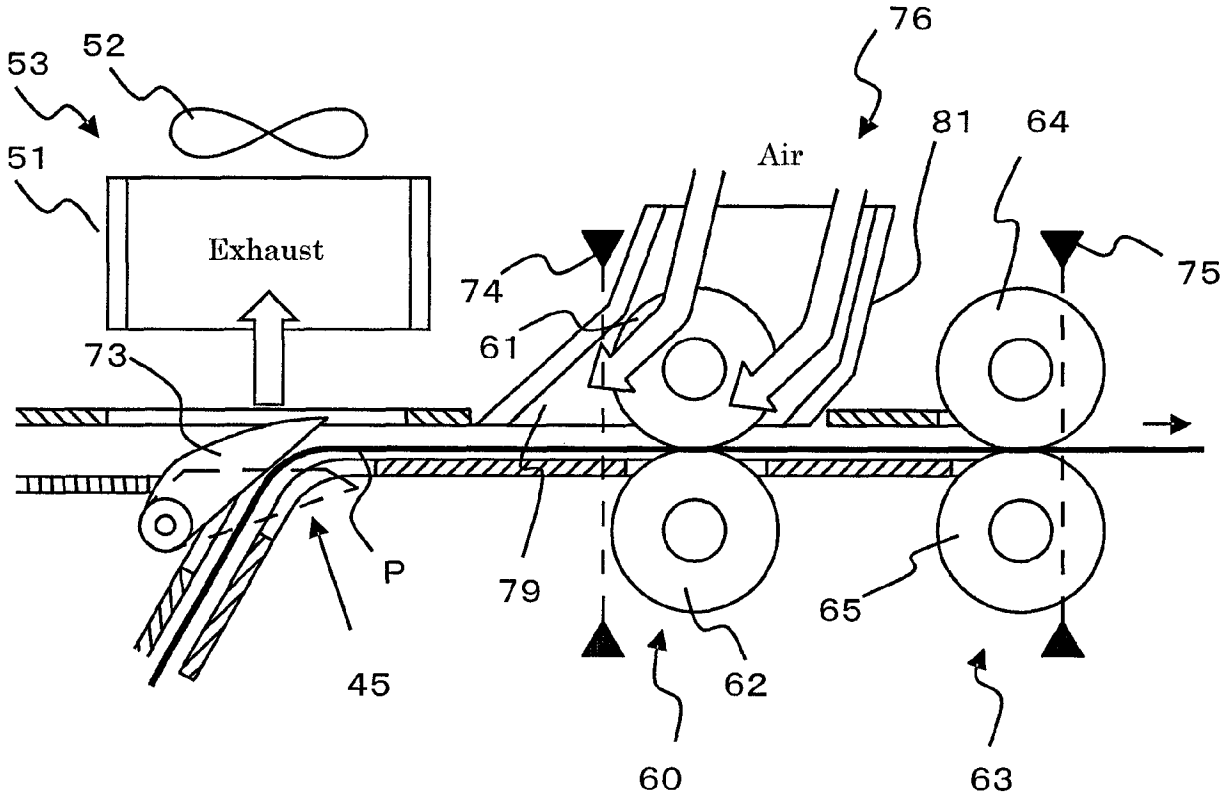
FIG. 11 A configurational diagram showing the second embodiment in which a cooling mechanism and an exhausting mechanism are arranged in conveying paths.

FIG. 11 is a configurational diagram showing the second embodiment in which a cooling mechanism and an exhausting mechanism are arranged in the conveying paths.

The same components as those in the first embodiment in FIG. 3 are allotted with common reference numerals. The difference from the first embodiment is the shape of a cooling duct 81, whose blowoff port 79 has a front end part that is bent toward the junction 45 side, as shown in FIG. 11. Accordingly, the cooling air is blown along the cooling duct from first conveying roller pair 60 to the junction 45 side. The operation of blowing cooling air is the same as that in the first embodiment, so that description is omitted.

In the present embodiment, since air flows along the conveying plane of the paper conveyed along second conveying path 43, high cooling effect is obtained in conveyance for paper discharge and also in duplex paper conveyance involving switching back. Further, since the cooling wind flowing along the conveying path is discharged by exhausting mechanism 53 so that the cooling wind is unlikely to flow to the periphery of fixing unit 21 which is located below, it is possible to avoid consumption of waste power to keep the temperature of fixing unit 21.

The 3rd Embodiment

Figure 12:
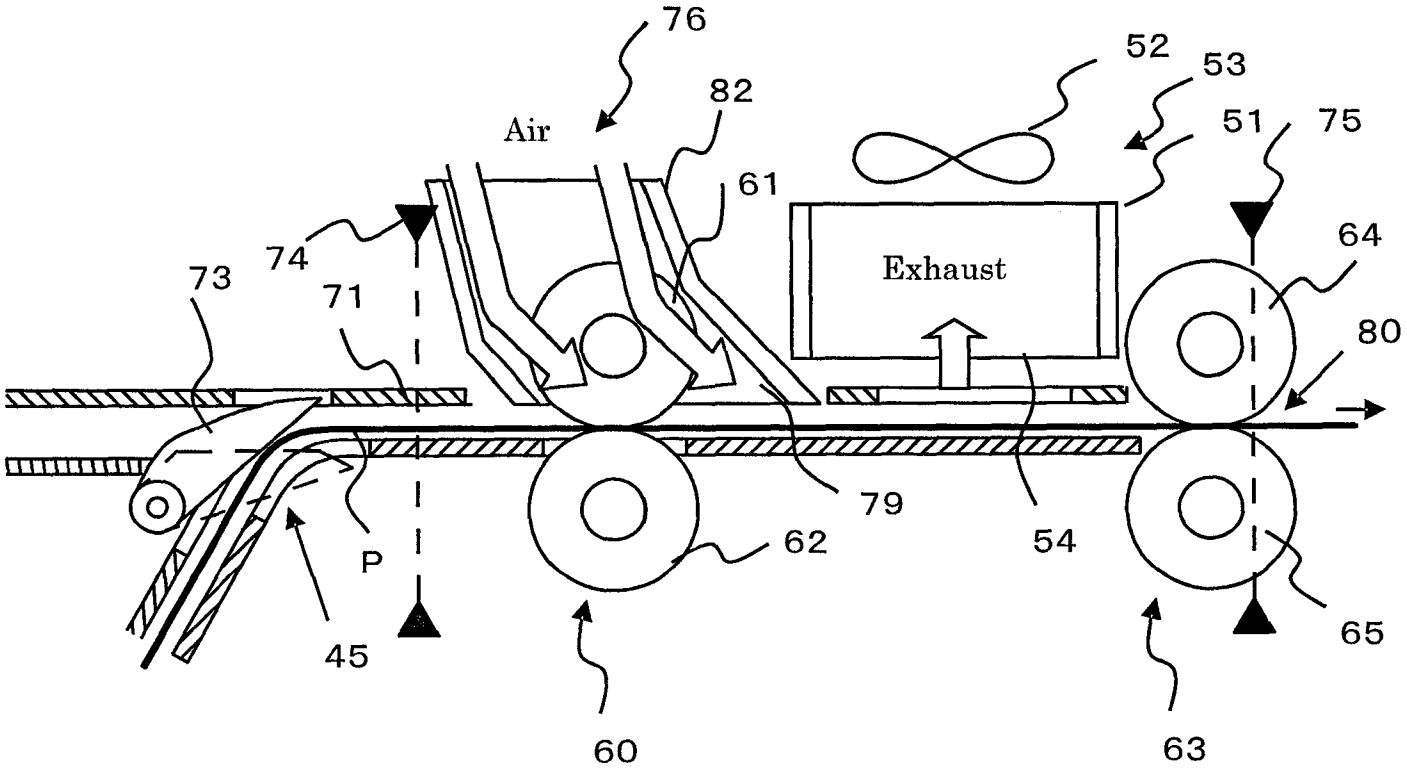
FIG. 12 A configurational diagram showing the third embodiment in which a cooling mechanism and an exhausting mechanism are arranged in conveying paths.

FIG. 12 is a configurational diagram showing the third embodiment in which a cooling mechanism and an exhausting mechanism are arranged in conveying paths.

The same components as those in the first embodiment in FIG. 3 are allotted with common reference numerals. The difference from the first embodiment is the shape of a cooling duct 82 and the position of exhausting duct 51. As shown in FIG. 12, the front end part of blowoff port 79 of cooling duct 82 is bent toward the output port 81 side. Accordingly, the cooling wind is blown along the cooling duct from first conveying roller pair 60 to the output port 80 side. Exhausting duct 51 is arranged between first conveying rollers 60 and second conveying rollers 63 so that its suction port 54 opposes the conveying path. The blowing operation of cooling wind of exhausting duct 51 is the same as that of the first embodiment so that description is omitted. Exhausting duct 51 is arranged between conveying roller pairs 60 and 63. An opening is provided in conveying guide 71 under exhausting duct 51, forming a ventilation port. Here, exhausting duct 51 is not limited to the above position but can be disposed as long as it is arranged on the output port 80 side beyond cooling duct 82.

In the present embodiment, since a cooling wind is blown toward output port 80 during conveyance through second conveying path 43, air is unlikely to enter the fixing unit side positioned, from junction 45 through first conveying path 42, no waste power for keeping the temperature of the fixing unit will be consumed. Besides, exhausting mechanism 53 is arranged on the output port 80 side of cooling mechanism 76 so as to discharge the cooling wind and make the cooling wind unlikely to flow into the periphery of fixing unit side 21. As a result, it is possible to avoid consumption of waste power to keep the temperature of fixing unit 21. Further, since the cooling wind blown from cooling duct 82 is unlikely to be discharged from output port 80, it is possible to suppress the paper discharged from output port 80, from being disorderly stacked onto paper output tray 2*a* due to pressing of exhausted air.

Blowoff port 79 of cooling duct 82 will never be disposed at the position of junction 45. This is because the cooling wind would reach fixing unit 21 from first conveying path 42 and lower the temperature, needing extra power to keep the temperature.

The 4th Embodiment

Figure 13:
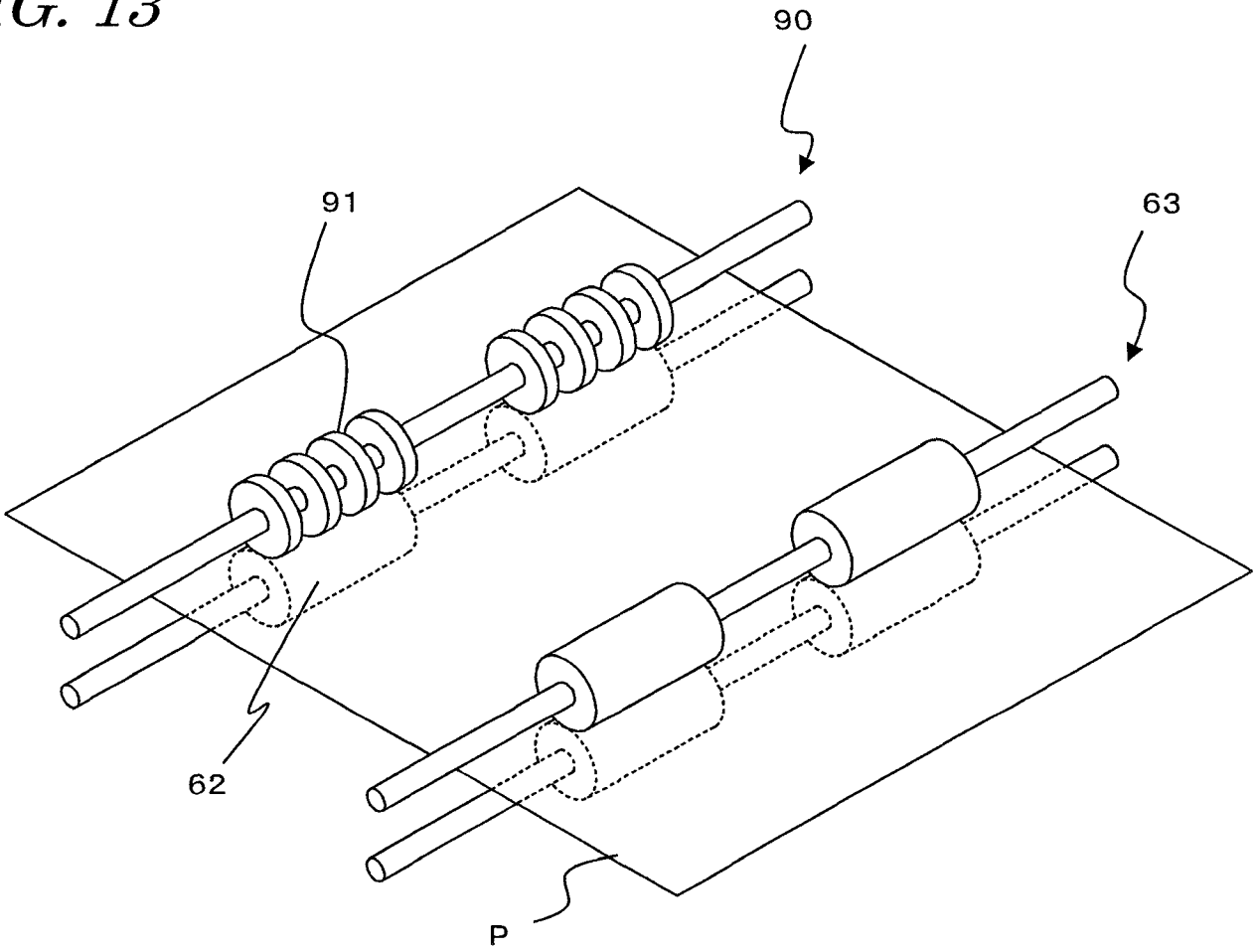
FIG. 13 A configurational diagram showing the fourth embodiment of conveying rollers in the second conveying path.

FIG. 13 is a configurational diagram showing the fourth embodiment of conveying rollers is second conveying path 43.

The same components as those in the first embodiment in FIG. 3 are allotted with common reference numerals. The difference from the first embodiment is the shape of a driven roller 91 of a first conveying roller pair 90. As shown in FIG. 13, driven roller 91 is formed of sets of multiple rollers having a small roller width. Alternatively, driven roller 91 may be formed of large-diametric rollers and small-diametric rollers in combination. In this way, driven roller 91 takes such a structure as to come into contact with the paper at intervals. That is, portions in contact with the paper and portions off the paper exist alternately in the axial direction.

The first to third embodiments entail the problem that the cooling efficiency in the part of paper onto which the wind is hard to apply due to shading of driven roller 61 lowers and that the driven roller creates air resistance, causing the need of a higher blowing pressure. In the present embodiment, air is blown through the gaps formed between rollers, so that it is possible to improve cooling efficiency and the air resistance of the driven rollers can be reduced, whereby it is no longer necessary to send a wind of a higher blowing pressure. Further, exhausting mechanism 53 is located on the upstream side of cooling mechanism 76 and exhausts cooling wind so that the cooling wind is unlikely to flow to the periphery of fixing unit 21 located below. Accordingly, it is possible to avoid consumption of waste power to keep the temperature of fixing unit 21.

The 5th Embodiment

Figure 14:
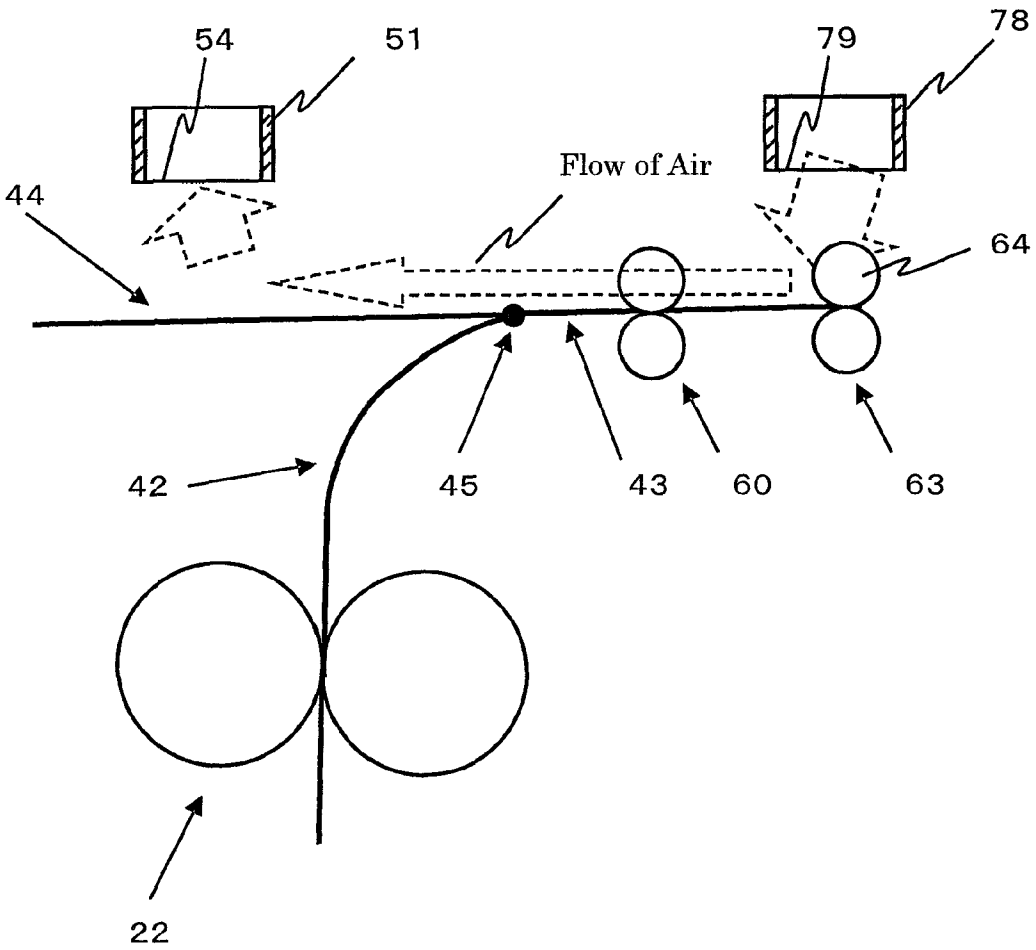
FIG. 14 A configurational diagram showing the fifth embodiment in which a cooling duct and an exhausting duct are arranged in conveying paths.

FIG. 14 is a configurational diagram showing the fifth embodiment in which a cooling duct and an exhausting duct are arranged in conveying paths.

Cooling duct 78 is arranged so as to enclose driven roller 64 of second conveying roller pair 63 to lead air from without to the paper P being conveyed. Though FIG. 14 is depicted simply, this has the same cooling duct configuration for the first conveying roller pair 60 in FIGS. 3, 4 and 5. Having the shape of cooling duct 81 illustrated in the second embodiment with FIG. 11 is further better.

Exhausting duct 51 is arranged so that suction port 54 opposes sixth conveying path 44. The exhausting duct has the same configuration as in FIG. 6.

In this way, the cool air blown from blowoff port 79 of cooling duct 78 flows from second conveying path 43 to sixth conveying path 44 (in the direction of the arrow) and is exhausted from exhausting duct 51. In particular, cooling wind is thus blown to second conveying roller pair 63 located apart from junction 45 to first conveying path 42, hence the cooling wind is unlikely to flow to the periphery of fixing unit 21 located below. Accordingly, it is possible to avoid consumption of waste power to keep the temperature of fixing unit 21. At the same time, heat rising from fixing portion 21 located below can be discharged so that no heat will build up inside the apparatus.

Here, cooling duct 78 and exhausting duct 51 may be arranged in opposite positions (cooling duct 78 and exhausting duct 51 are disposed in sixth conveying path 44 and second conveying path 43, respectively). In this case, having the shape of cooling duct 82 illustrated in the third embodiment with FIG. 12 is further better.

In this way, the cool air blown from blowoff port 79 of cooling duct 78 flows from second conveying path 43 to sixth conveying path 44 (in the direction of the arrows) and is exhausted from exhausting duct 51. In particular, when cooling wind is adapted to be blown to the conveying roller pair in sixth conveying path located apart from junction 45 to first conveying path 42, the cooling wind is unlikely to flow to the periphery of fixing unit 21 located below. Accordingly, it is possible to avoid consumption of waste power to keep the temperature of fixing unit 21. At the same time, heat rising from fixing unit 21 located below can be discharged so that no heat will build up inside the apparatus.

The 6th Embodiment

Figure 15:
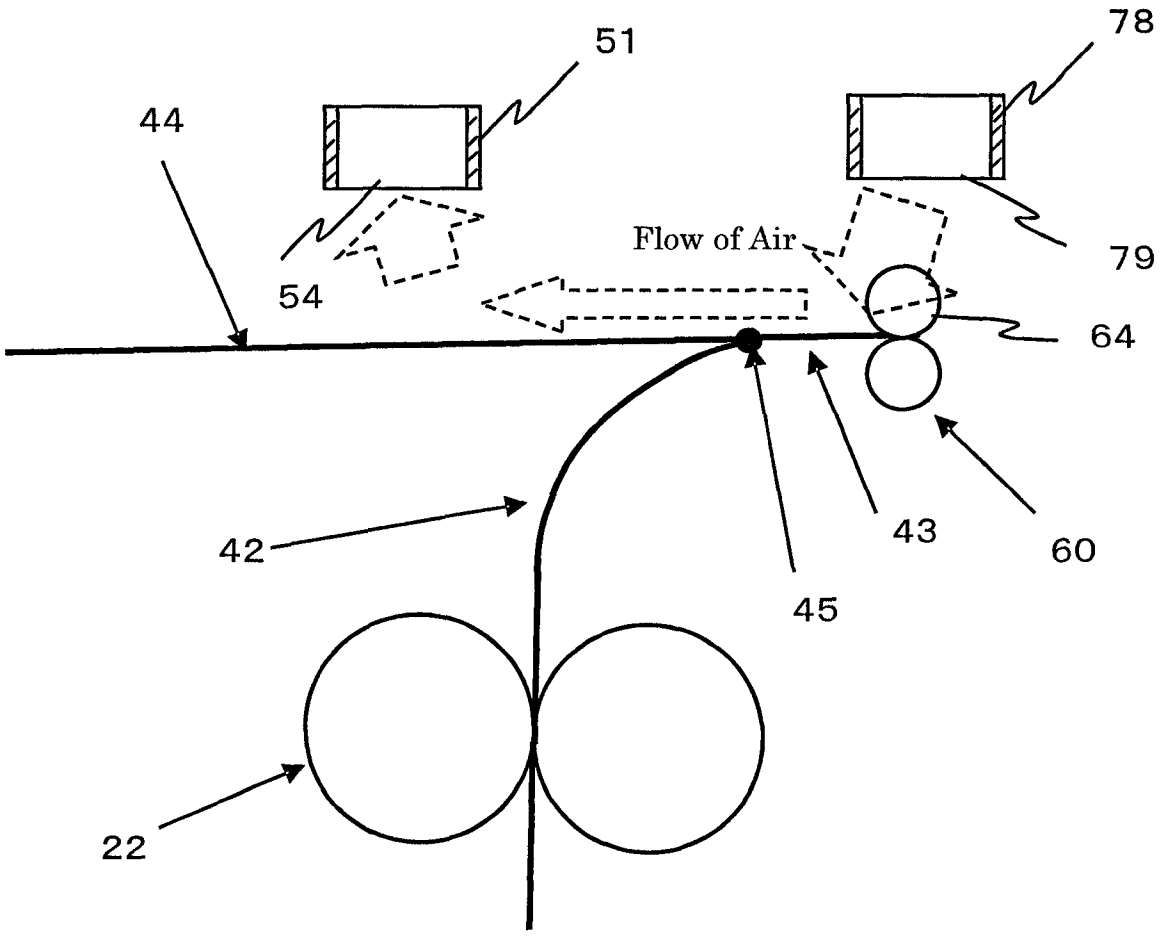
FIG. 15 A configurational diagram showing the sixth embodiment in which a cooling duct and an exhausting duct are arranged in conveying paths.

FIG. 15 is a configurational diagram showing the sixth embodiment in which a cooling duct and an exhausting duct are arranged in conveying paths.

As in the first embodiment, cooling duct 78 is arranged so as to enclose driven roller 64 of first conveying roller pair 60 to lead air from without to the paper P being conveyed. Though FIG. 14 is depicted simply, this has the same cooling duct configuration for the first conveying roller pair 60 in FIGS. 3, 4 and 5. Having the shape of cooling duct 81 illustrated in the second embodiment with FIG. 11 is further better.

Exhausting duct 51 is arranged so that suction port 54 opposes sixth conveying path 44. The exhausting duct has the same configuration as in FIG. 6.

In this way, the cool air blown from blowoff port 79 of cooling duct 78 flows from second conveying path 43 to sixth conveying path 44 (in the direction of the arrow) and is exhausted from exhausting duct 51. Since the air flows from the blowoff port to the suction port while the cooling wind is unlikely to flow to the periphery of fixing unit 21 located below, it is possible to avoid consumption of waste power to keep the temperature of fixing unit 21. At the same time, heat rising from fixing unit 21 located below is discharged so that no heat will build up inside the apparatus.

Here, if similarly to the first embodiment a predetermined length of an approximately horizontal flat portion is formed in second conveying path 43 from junction 45 to cooling duct 78, the cooling wind is more unlikely to flow to the periphery of fixing unit 21 located below.

Here, cooling duct 78 and exhausting duct 51 may be arranged in opposite positions (cooling duct 68 and exhausting duct 51 are disposed in sixth conveying path 44 and second conveying path 43, respectively). In this case, having a shape of cooling duct 82 illustrated in the third embodiment with FIG. 12 is further better.

In this way, the cool air blown from blowoff port 79 of cooling duct 78 flows from second conveying path 43 to sixth conveying path 44 (in the direction of the arrow) and is exhausted from exhausting duct 51. Since the air flows from the blowoff port to the suction port while the cooling wind is unlikely to flow to the periphery of fixing unit located below, it is possible to avoid consumption of waste power to keep the temperature of fixing unit 21. At the same time, heat rising from fixing unit 21 located below is discharged so that no heat will build up inside the apparatus.

In particular, if a predetermined length of an approximately horizontal flat portion is formed in sixth conveying path 44 from junction 45 with first conveying path 42 to cooling duct 78, the cooling wind is more unlikely to flow to the periphery of fixing unit 21 located below.

DESCRIPTION OF REFERENCE NUMERALS

X image forming apparatus
20 electrophotographic processor
21 fixing unit
22 fixing roller pair
22*a* heating roller
22*b* pressing roller
42 first conveying path
43 second conveying path
44 sixth conveying path
50 supporting member
51 exhausting duct
52 exhausting fan
53 exhausting mechanism
60, 63, 90 conveying roller pair
61, 64, 91 driven roller
62, 65 drive roller
71 upper conveying guide
72 lower conveying guide
80 output port
73 gate
74, 75 paper sensor
76 cooling mechanism
77 cooling fan
78 cooling duct
79 blowoff port
80 output port
81, 82 cooling duct
83 rib

The invention claimed is:

1. An image forming apparatus, comprising:

an image forming portion configured to form an image on a recording medium, a fixing portion configured to thermally fix the image onto the recording medium after image forming, a post-fixing conveying path configured to convey the recording medium after thermal fixing by the fixing portion; and a blowing mechanism for sending wind;

wherein the post-fixing conveying path has a switchback conveying path for conveying the recording medium to the image forming portion again, and an opening portion for flowing the wind from the blowing mechanism into the switch back conveying path is provided.

2. The image forming apparatus according to claim 1, wherein the opening portion is a blowoff port of the wind from the blowing mechanism.

3. The image forming apparatus according to claim 1, wherein an opening portion for discharging air in the post-fixing conveying path is arranged on a surface side of the post-fixing conveying path, and the surface side is the same as a surface side of the switch back conveying path on which the opening portion for flowing the wind into the switch back conveying path is arranged.

4. The image forming apparatus according to claim 1, wherein the opening portion for flowing the wind into the switch back conveying path is arranged on an arrangement position on which a conveying roller being arranged in the switch back conveying path is arranged.

5. The image forming apparatus according to claim 1, further comprising a duplex conveying path for performing duplex printing of the recording medium switched back by the switch back conveying path, wherein an opening portion for discharging air in the switchback conveying path is provided on the duplex conveying path.

* * * * *